US010814644B2

(12) United States Patent
Hirano et al.

(10) Patent No.: US 10,814,644 B2
(45) Date of Patent: Oct. 27, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Azusa Hirano, Yokohama (JP); Yasutsugu Tsuruoka, Yokohama (JP); Noritsugu Tanio, Yokohama (JP); Shinichi Ogimoto, Yokohama (JP); Junsuke Komito, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 16/368,532

(22) Filed: Mar. 28, 2019

(65) Prior Publication Data

US 2019/0217631 A1 Jul. 18, 2019

Related U.S. Application Data

(63) Continuation of application No. PCT/JP2017/033638, filed on Sep. 19, 2017.

(30) Foreign Application Priority Data

Sep. 30, 2016 (JP) ..... 2016-195009
Oct. 4, 2016 (JP) ..... 2016-196101

(51) Int. Cl.
*B41J 3/407* (2006.01)
*B41M 5/00* (2006.01)
(Continued)

(52) U.S. Cl.
CPC ..... *B41J 3/4073* (2013.01); *B41J 2/04581* (2013.01); *B41J 2/145* (2013.01);
(Continued)

(58) Field of Classification Search
CPC ..... B41J 3/407; B41J 11/007; B41J 11/0085; B41J 2/145; B41J 3/4073; B41J 13/0009;
(Continued)

(56) References Cited

U.S. PATENT DOCUMENTS

2004/0263545 A1 12/2004 Esaki et al.
2011/0128557 A1 6/2011 Kinoshita et al.
(Continued)

FOREIGN PATENT DOCUMENTS

JP 7-81050 3/1995
JP 2005-22114 1/2005
(Continued)

OTHER PUBLICATIONS

International Search Report dated Nov. 14, 2017 in PCT/JP2017/033638 filed Sep. 19, 2017.

*Primary Examiner* — Jannelle M Lebron
(74) *Attorney, Agent, or Firm* — Oblon, McClelland, Maier & Neustadt, L.L.P.

(57) ABSTRACT

According to one embodiment, a tablet printing apparatus includes a conveyor, an inkjet print head, and a controller. The conveyor is configured to convey a tablet having an outer shape that does not determine the printing direction of a print pattern to be printed thereon. The print head includes a plurality of nozzles each configured to eject a liquid to print the print pattern on the tablet being conveyed. The controller is configured to control the print head to perform printing on the tablet being conveyed such that the printing direction of the print pattern is changed at predetermined intervals at least between a first direction which is parallel to or crosses the conveying direction of the tablet, and a second direction which crosses the conveying direction, and in which more nozzles are used for printing than in the first direction.

20 Claims, 3 Drawing Sheets

(51) Int. Cl.
*B41J 2/045* (2006.01)
*B41J 2/145* (2006.01)
*B41J 11/00* (2006.01)

(52) U.S. Cl.
CPC ..... *B41J 3/407* (2013.01); *B41J 11/008* (2013.01); *B41M 5/0047* (2013.01); *B41M 5/0088* (2013.01)

(58) Field of Classification Search
CPC .. B41J 11/008; B41J 2/04581; B41M 5/0088; B41M 5/0047
See application file for complete search history.

(56) References Cited

U.S. PATENT DOCUMENTS

| | | | |
|---|---|---|---|
| 2012/0132722 | A1 | 5/2012 | Ackley, Jr. et al. |
| 2017/0259595 | A1 | 9/2017 | Aoyagi et al. |

FOREIGN PATENT DOCUMENTS

| | | | |
|---|---|---|---|
| JP | WO2009/025371 | A1 | 2/2009 |
| JP | 5281009 | B2 | 9/2013 |
| JP | 2015-166053 | | 9/2015 |
| JP | 2015-204943 | | 11/2015 |
| JP | 2016-55057 | | 4/2016 |
| JP | WO2016/084812 | A1 | 6/2016 |

TABLET PRINTING APPARATUS AND TABLET PRINTING METHOD

CROSS-REFERENCE TO THE RELATED APPLICATION

This application is based upon and claims the benefit of priority from International Application No. PCT/JP2017/033638, filed on Sep. 19, 2017, Japanese Patent Applications No. 2016-195009, filed on Sep. 30, 2016 and No. 2016-196101, filed on Oct. 4, 2016; the entire contents of all of which are incorporated herein by reference.

FIELD

Embodiments described herein relate generally to a tablet printing apparatus and a tablet printing method.

BACKGROUND

A technique that uses an inkjet print head to preform printing is known for printing identification information such as characters, letters, marks or the like on a tablet. In the tablet printing apparatus that uses this technique, a plurality of tablets are conveyed in a row by a conveyor. The inkjet print head is located above the conveyor, and ejects ink (for example, edible ink) from its nozzle toward each of the tablets passing under it to print identification information on the tablets on the conveyor.

The print head of the tablet printing apparatus is subject to regular maintenance to maintain its normal operation. Generally, each time the maintenance of the print head is required, the conveyance of tablets has to be stopped. During this period, printing on tablets is suspended. Therefore, the productivity decreases as the frequency of maintenance increases or the time taken for a single maintenance activity increases.

DETAILED DESCRIPTION

Figure 1:
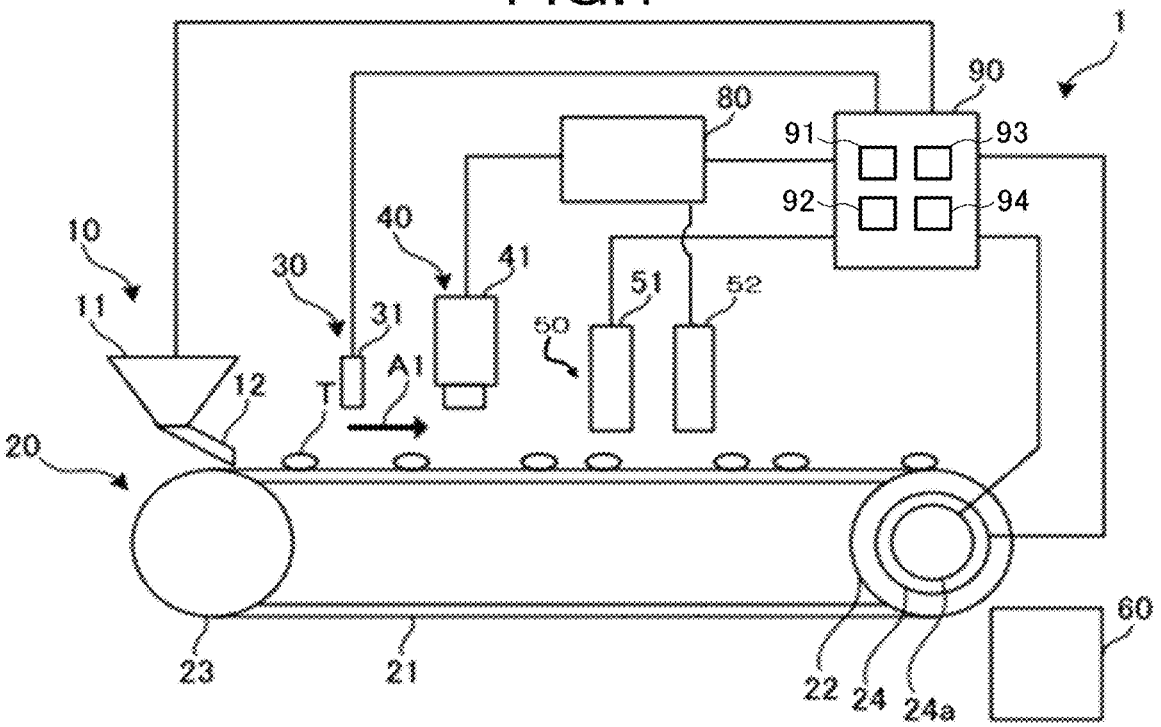
FIG. 1 is a diagram illustrating a schematic configuration of a tablet printing apparatus according to a first embodiment.

According to one embodiment, a tablet printing apparatus includes: a conveyor configured to convey a tablet having an outer shape that does not determine the printing direction of a print pattern to be printed thereon; an inkjet print head including a plurality of nozzles each configured to eject a liquid to print the print pattern on the tablet being conveyed; and a controller configured to control the print head to perform printing on the tablet being conveyed such that the printing direction of the print pattern is changed at predetermined intervals at least between a first direction which is parallel to or crosses the conveying direction of the tablet, and a second direction which crosses the conveying direction, and in which more nozzles are used for printing than in the first direction.

According to another embodiment, a tablet printing apparatus includes: a conveyor configured to convey a tablet having an outer shape that does not determine the printing direction of a print pattern to be printed thereon; an inkjet print head including a plurality of nozzles each configured to eject a liquid to print the print pattern on the tablet being conveyed; and a controller configured to control the print head to perform printing on the tablet being conveyed such that the print pattern is printed in a direction which crosses the conveying direction of the tablet, and in which more nozzles are used for printing than when the print pattern is printed in a direction parallel to the conveying direction.

According to still another embodiment, a tablet printing method includes: conveying, by a conveyor, a tablet having an outer shape that does not determine the printing direction of a print pattern to be printed thereon; printing, by an inkjet print head, the print pattern on the tablet being conveyed, the print head including a plurality of nozzles each configured to eject a liquid; and controlling, by a controller, the print head to perform printing on the tablet being conveyed such that the printing direction of the print pattern is changed at predetermined intervals at least between a first direction which is parallel to or crosses the conveying direction of the tablet, and a second direction which crosses the conveying direction, and in which more nozzles are used for printing than in the first direction.

According to still another embodiment, a tablet printing method includes: conveying, by a conveyor, a tablet having an outer shape that does not determine the printing direction of a print pattern to be printed thereon; printing, by an inkjet print head, the print pattern on the tablet being conveyed, the print head including a plurality of nozzles each configured to eject a liquid; and controlling, by a controller, the print head to perform printing on the tablet being conveyed such that the print pattern is printed in a direction which crosses the conveying direction of the tablet, and in which more nozzles are used for printing than when the print pattern is printed in a direction parallel to the conveying direction.

First Embodiment

A first embodiment will be described with reference to FIGS. 1 to 7.

(Basic Configuration)

Figure 2:
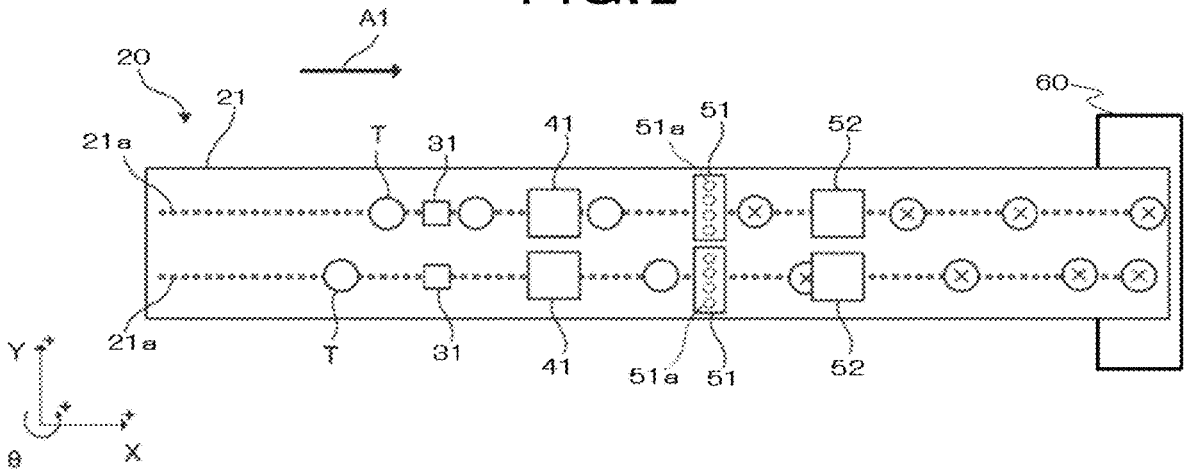
FIG. 2 is a plan view of the tablet printing apparatus illustrated in FIG. 1.

As illustrated in FIGS. 1 and 2, a tablet printing apparatus 1 of the first embodiment includes a supply device (supplier) 10, a conveying device (conveyer) 20, a detecting device (detector) 30, an imaging device (imager) 40, a printing device (printer) 50, post-printing imaging units (imagers) 52, a collecting device (collector) 60, an image processing device (processer) 80, and a control device (controller) 90.

The supply device 10 includes a hopper 11 and a chute 12. The hopper 11 stores a number of tablets T and sequentially supplies the tablets T to the chute 12. The chute 12 aligns the tablets T in a plurality of rows, and supplies them to the conveying device 20. The supply device 10 is electrically connected to the control device 90, and is driven under the control of the control device 90.

For example, the tablets T may be completely circular in plan view and have no split line.

The conveying device 20 includes a conveyor belt (see FIG. 2), a drive pulley 22, a driven pulley 23, and a drive unit (actuator) 24. The conveyor belt 21 is formed as an endless belt, and wrapped around the drive pulley 22 and the driven pulley 23. The drive pulley 22 and the driven pulley 23 are arranged to be rotatable about a shaft, and the drive pulley 22 is connected to the drive unit 24. The drive unit 24 is electrically connected to the control device 90, and is driven under the control of the control device 90. The drive unit 24 includes a position detector 24*a* such as a rotary encoder. The position detector 24*a* sends a detection signal to the control device 90. The control device 90 can obtain information such as the position, speed, and movement amount of the conveyor belt 21 based on the detection signal.

In the conveying device 20, the conveyor belt 21 rotates together with the driven pulley 23 as the drive pulley 22 is rotated by the drive unit 24 to convey the tablets T thereon in the direction of arrow A1 in FIGS. 1 and 2 (conveying direction A1). In the conveyor belt 21, two lines of hole-shaped suction ports 21*a* (see FIG. 2) are formed along the conveying direction A1. The two lines of the suction ports 21*a* are connected to a suction device (sucker) via a suction chamber (both not illustrated), and suction force is obtained by driving the suction device (for example, a suction pump). The tablets T supplied onto each of the suction ports 21*a* are held on the conveyor belt 21 by suction from the suction ports 21*a*.

The detecting device 30 includes a plurality of detection units (detectors) 31 (see FIG. 2). The two detection units 31 are arranged above the conveyor belt 21. The detection units 31 are located on the downstream side of the supply device 10 in the conveying direction A1 above the two lines of the suction ports 21*a*, and are arranged in a direction crossing the conveying direction A1 (for example, a direction perpendicular to the conveying direction A1) in the horizontal plane. Each of the detection units detects the tablets T on the conveyor belt 21 by projecting and receiving laser beams. The detection units 31 are each electrically connected to the control device 90, and send a detection signal to the control device 90. Various laser sensors (laser displacement sensor) such as reflection laser sensors can be used as the detection units 31. Besides, laser beams in various shapes such as spot beams and line beams can be used.

The imaging device 40 includes a plurality of imaging units (imagers) 41 (see FIG. 2). The two imaging units 41 are arranged above the conveyor belt 21. The imaging units 41 are located on the downstream side of the detecting device 30 in the conveying direction A1 above the two lines of the suction ports 21*a*, and are arranged in a direction crossing the conveying direction A1 (for example, a direction perpendicular to the conveying direction A1) in the horizontal plane. Each of the imaging units 41 performs imaging at the time when each of the tablets T reaches just under it to capture an image including the upper surface of the tablet T, and sends the image to the image processing device 80. Various cameras having an imaging device such as a charge-coupled device (CCD) or a complementary metal-oxide semiconductor (CMOS) can be used as the imaging units 41. The imaging units 41 are each electrically connected to the control device 90 via the image processing device 80, and are driven under the control of the control device 90. There may also be provided an illumination for imaging as necessary.

The printing device 50 includes inkjet print heads 51. The two print heads 51 are arranged above the conveyor belt 21. The print heads 51 are located on the downstream side of the imaging device 40 in the conveying direction A1. The print heads 51 each include a plurality of nozzles 51*a* (see FIG. 2), and ejects ink (an example of liquid) individually from each of the nozzles 51*a*. Although FIG. 2 illustrates only four of the nozzles 51*a*, actually, there may be several tens to several thousands of nozzles. The print heads 51 are arranged such that the direction in which the nozzles 51*a* are aligned crosses (for example, perpendicularly to) the conveying direction A1 in the horizontal plane. Various inkjet print heads having a drive element such as a piezoelectric element, a heating element, or a magnetostrictive element for each of the nozzles 51*a* can be used as the print heads 51. The print heads 51 are each electrically connected to the control device 90, and are driven under the control of the control device 90.

The two post-printing imaging units 52 are arranged above the conveyor belt 21, and are located on the downstream side of the print heads 51 in the conveying direction A1. The post-printing imaging units 52 are arranged in a direction crossing the conveying direction A1 (for example, a direction perpendicular to the conveying direction A1) in the horizontal plane. Each of the post-printing imaging units 52 performs imaging at the time when each of the tablets T reaches just under it to capture an image including the upper surface of the tablet T, and sends the image to the image processing device 80. Similarly to the imaging units 41, various cameras having an imaging device such as CCD or CMOS can be used as the post-printing imaging units 52. The post-printing imaging units 52 are each electrically connected to the control device 90 via the image processing device 80, and are driven under the control of the control device 90. There may also be provided an illumination for imaging as necessary.

The collecting device 60 is located on the downstream side of the post-printing imaging units 52 in the conveying direction A1. The collecting device 60 is arranged at the end of the conveying device 20, i.e., the end of the conveyor belt 21 on the downstream side in the conveying direction A1. The collecting device 60 is configured to be able to sequentially receive and collect the tablets T released from the hold of the conveying device 20 and dropped therefrom. Incidentally, the conveying device releases the hold of each of the tablets T on the conveyor belt 21 when the tablet T reaches a desired position such as, for example, the end of the conveyor belt 21 on the downstream side in the conveying direction A1.

The image processing device 80 receives each image captured by the imaging device 40, and processes the image using a known image processing technique. Having received an image from the imaging device 40, the image processing device 80 detects the position shift of the tablet T in the X and Y directions. The position shift in the X and Y directions refers herein to a shift in the position of the tablet T with respect to the center of the imaging field of view, and indicates how much the tablet T has shifted from the center. In this embodiment, for example, the X direction corresponds to the conveying direction A1, while the Y direction corresponds to a direction perpendicular thereto.

The image processing device 80 sends information on the detected position shift of the tablet T in the X and Y directions to the control device 90. The image processing device 80 adds identification information of one of the imaging units 41 to the position shift information to be sent to the control device 90. Thereby, the control device 90 can identify that the sent position shift information corresponding to the tablet T of which row, where the tablet T is conveyed in two rows on the conveyor belt 21.

The image processing device 80 also receives each image captured by the post-printing imaging unit 52, and processes the image using a known image processing technique. Having received an image from the post-printing imaging unit 52, the image processing device 80 checks whether print state (printed condition) in the image received from the post-printing imaging unit 52 matches printing condition for the tablet T (described later), and sends information on the check to the control device 90. According to the information received from the image processing device 80, when the match rate is, for example, 90% or more, the control device 90 determines the tablet T to be "acceptable" and collects it by the collecting device 60. When the match rate is less than 90%, the control device 90 determines the tablet T to be "defective" and collects it in a defective product box (not illustrated).

The control device 90 includes an input/output device (circuitry) 91, a microcomputer 92 that intensively controls each unit, a storage 93 that stores various information, various programs, and the like, and a print data switching unit (switcher) 94. The control device 90 controls the supply device 10, the conveying device 20, the imaging device 40, the post-printing imaging unit 52, and the printing device 50 based on various information (for example, process information) and various programs. In addition, the control device 90 receives detection signals and the like sent from the detecting device 30 and the position detector 24*a*.

The input/output device 91 receives input of various types of information such as a print pattern, and outputs various types of information. The storage 93 stores the input print pattern. The storage 93 also stores print data composed of a dot pattern. The print data is generated as to which of the nozzles 51*a* of the inkjet print heads 51 is to be used for ejecting ink and the timing thereof from the print pattern. Further, rotated print data is generated by rotating the print data with respect to a direction parallel to the conveying direction A1 of the tablets T, which is set as 0 degrees, and stored in the storage 93. The rotated print data is generated at each predetermined angle. The angle by which the print data is rotated is hereinafter referred to as "print data rotation angle". The print data switching unit 94 switches pieces of print data, each obtained at a different print data rotation angle, from one to another at predetermined intervals.

For example, the storage 93 stores 0° print data, 15° print data, 30° print data, and 45° print data obtained by rotating a print pattern such as characters, letters, or marks to be printed on the tablets T by increments of 15 degrees from 0 degrees. The control device 90 selects one from these pieces of print data to set printing condition. The nozzles 51*a* to be used vary depending on the angle of the print data selected (details will be described later). Note that the term "0° print data" as used herein refers to data of a print pattern to be printed in parallel with the conveying direction A1 of the tablets T (a pattern printed based on this data is hereinafter referred to as "reference pattern"). The angles 0°, 15°, 30°, and 45° each indicate the print data rotation angle. The direction defined by the print data rotation angle with respect to the conveying direction A1 of the tablets T is the printing direction with respect to the conveying direction A1 of the tablets T.

In the field of tablet printing, there has been known a technology for printing on a tablet having a split line (hereinafter referred to as "split-line tablet") or a tablet in a shape that is not completely circular (hereinafter referred to as "irregular-shaped tablet"). When printing is performed on tablets having directional properties such as split-line tablets or irregular-shaped tablets, their shifts in the e direction are detected based on images captured by the imaging device 40, and the print data stored in the storage 93 is rotated to be used. On the other hand, when printing is performed on tablets that are completely circular in plan view and have no split line as with the tablets T of this embodiment, there is no need to rotate the print data since the tablets T has no directional property. That is, the tablet T is a tablet on which printing can be performed without considering the directionality, i.e., a tablet having an outer shape that does not determine the printing direction or orientation of a print pattern to be printed thereon. Incidentally, "completely circular" is a term that covers circular shapes that are perfectly or almost perfectly round. Accordingly, printing is always performed using data having an angle in a reference direction (for example, 0 degrees). If printing is always performed using data of the same angle, only the nozzles 51*a* in a specific range are kept being used intensively.

As described above, various types of inkjet print heads having a drive element such as a piezoelectric element, a heating element, or a magnetostrictive element can be used as the print heads 51. The drive element has a usage limit, and, when the drive element reaches its usage limit (lifetime), maintenance is required to replace the drive element together with the print head 51. The nozzles 51*a* in a specific range, which are kept being used intensively as described above, use the drive element more frequently than those in other ranges. As a result, the drive element reaches the end of its lifetime earlier, and the print heads 51 need to be replaced more frequently. A considerable amount of time is required for maintenance to replace the print heads 51. Printing on the tablets T is suspended during this stop period. Therefore, the productivity decreases greatly as the frequency of maintenance increases.

Besides, ink adheres to the periphery of the nozzles 51*a* used at high frequency, which causes liquid pooling and thus prevents proper ejection of the ink. Meanwhile, in the nozzles 51*a* used at low frequency, ink is thickened, or solid matter is precipitated, resulting in that the ink may not be properly ejected from the nozzles 51*a*. In order to prevent this, it is conventionally necessary to perform maintenance work such as cleaning of the periphery of the nozzles 51*a*, for example, about once every 10 minutes, by using a maintenance device (not illustrated). Generally, as described above, each time the print heads 51 require maintenance, printing on tablets has to be suspended. Since printing is not performed on the tablets T during this suspension period, the productivity decreases as the frequency of maintenance increases or the time taken for a single maintenance activity increases.

The present inventors have found that this can be solved by using ingenuity at the time of setting printing conditions. In the following, the setting of printing conditions will be explained in detail along with the description of a printing step performed by the tablet printing apparatus 1.

(Printing Step)

A printing step (printing process) performed by the tablet printing apparatus 1 will be described.

Various types of information such as print data required for printing is stored in the storage 93 of the control device 90. Besides, a number of tablets T to be printed are fed in the hopper 11 of the supply device 10. When the tablet printing apparatus 1 is driven, the conveyor belt 21 of the conveying device 20 rotates in the conveying direction A1 as the drive pulley 22 and the driven pulley 23 are rotated by the drive unit 24. While the conveyor belt 21 is rotating, the supply device 10 sequentially supplies the tablets T onto the conveyor belt 21 not at regular intervals but at random. The tablets T are conveyed on the conveyor belt 21 at a predetermined speed.

Each of the detection units 31 detects each of the tablets T on the conveyor belt 21, and feeds the control device 90 with a detection signal as a trigger signal. Thereafter, each of the imaging units 41 captures an image of each of the tablets T on the conveyor belt 21. The imaging unit 41 captures an image of the upper surface of the tablet T at the timing based on the trigger signal, i.e., at the time when the tablet T reaches under the imaging unit 41, and sends the image to the image processing device 80. The image processing device 80 generates information on the position shift of the tablet T (for example, the position shift of the tablet T in the X and Y directions) based on the image received from the imaging unit 41, and sends the position shift information to the control device 90.

At this time, the print data rotation angle is set. As described above, the storage 93 of the control device 90 stores 0° print data, 15° print data, 30° print data, and 45° print data obtained by rotating a print pattern such as characters, letters, or marks by increments of 15 degrees from 0 degrees. First, the control device 90 selects the 0° print data having a print data rotation angle of 0 degrees, and sets printing condition based on the 0° print data. The control device 90 of this embodiment adds the position shift information of the tablets T received from the image processing device 80 to the selected print data and corrects the printing conditions for each of the tablets T when, for example, the position of the tablet T has shifted in the Y direction or the like.

Thereafter, the printing device 50 performs printing on each of the tablets T on the conveyor belt 21 by using the 0° print data (first direction) at the timing based on the trigger signal, i.e., at the time when the tablet T reaches under one of the print heads 51 based on the printing condition. The print head 51 of the printing device 50 ejects ink as appropriate from each of the nozzles 51*a* to print identification information such as characters, letters, or marks on the upper surface of the tablet T. The ink applied to the tablet T is dried before the collecting device 60 collects the tablet T. After the printing, the post-printing imaging unit 52 captures an image of the tablet T. When the control device 90 determines print state on the tablet T to be "acceptable", the tablet T is released from the hold at the downstream end of the conveyor belt 21 and dropped therefrom to be collected by the collecting device 60.

When a predetermined time (for example, 3 minutes) set in advance has elapsed since the start of the printing process, the control device 90 switches the 0° print data to the 15° print data (second direction) having a print data rotation angle of 15 degrees, and changes the printing condition based on the 15° print data. Then, the above printing process is performed under the new printing condition. While a predetermined time that is set in advance is cited as the interval at which the print data is switched, the print data may be switched based on, for example, the number of times the drive element has been used (ejection count), the number of tablets on which printing has been performed, or the like.

When the predetermined time has elapsed since the change of the printing condition, the control device 90 switches the 15° print data to the 30° print data (third direction) having a print data rotation angle of 30 degrees, and changes the printing condition based on the 30° print data. Then, the above printing process is performed under the new printing condition.

When the predetermined time has elapsed again, the control device 90 switches the 30° print data to the 45° print data (fourth direction) having a print data rotation angle of 45 degrees, and changes the printing condition based on the 45° print data. Then, the above printing process is performed under the new printing condition.

When the predetermined time has elapsed again, the control device 90 switches the 45° print data back to the 0° print data. After that, the printing process is continued while the printing condition are changed in this manner according to the switching of the 15°, 30°, or 45° print data each time the predetermined time has elapsed.

As described above, each time the predetermined time has elapsed, print data are switched from one to another, which are different in print data rotation angle by 15 degrees. When, for example, one hour has elapsed since the start of the printing process, the printing process is suspended, and maintenance work is performed by a maintenance device (not illustrated).

FIGS. 3 to 6 each illustrate the ejection counts of the nozzles 51*a* with respect to each print data rotation angle when a print pattern "XYZ 789" is printed on one tablet T. It is assumed herein that printing is performed on the tablet T by using one of the print heads 51 having 161 nozzles (51*a*) therein. In the figures, the rotated state of the print pattern on the tablet T is illustrated on the left side (the number indicates the print data rotation angle), and a graph, in which the vertical axis indicates the hole numbers of the nozzles 51*a* and the horizontal axis indicates the ejection count of each of the nozzles 51*a*, is illustrated on the right side. Note that this data illustrates a case where the tablet T has not shifted in the Y direction.

As illustrated in FIGS. 3 to 6, the ejection counts of the nozzles 51*a* vary depending on the print data rotation angles of 0, 15, 30, 45 degrees. For example, when the print data rotation angle is 0 degrees (see FIG. 3), ejection does not take place at all from the nozzles 51*a* having hole numbers around 64 to 101. Meanwhile, when the print data rotation angle is 15 degrees (see FIG. 4), those having hole numbers around 73 to 92 are not used; the range of unused nozzles is reduced. In the case of the print data rotation angle of 0 degrees described above, ejection is performed only by the nozzles 51*a* having hole numbers around 26 to 63 and 102 to 139. On the other hand, when the print data rotation angle is 30 degrees (see FIG. 5), ejection is performed by the nozzles 51*a* having hole numbers around 18 to 82 and 85 to 144. When the print data rotation angle is 45 degrees (see FIG. 6), ejection is performed by the nozzles 51*a* having hole numbers around 18 to 143. That is, a wider range of the nozzles 51*a* are used than in the case of 0 degrees. Further, when the print data rotation angle is 45 degrees, ink is ejected from the nozzles 51*a* having hole numbers 64 to 101, which are not used when the print data rotation angle is 0 degrees.

In this manner, pieces of print data each having a different print data rotation angle are switched from one to another at predetermined time intervals, and accordingly printing conditions are changed. With this, the process of ink ejection can be distributed among the nozzles 51*a*. Each time printing conditions are changed, the tablets T are printed with patterns of different angles with respect to the conveying direction A1. When checking the print state based on an image captured by the post-printing imaging unit 52, the image processing device 80 checks the match rate based on the image of the tablet captured after printing while taking into account the print data rotation angle used in printing on the tablet, i.e., printing condition.

When the position of the tablet T has shifted in the Y direction, as described above, the control device 90 of this embodiment adds the position shift information of the tablets T received from the image processing device 80 to the selected print data and corrects the printing conditions for each of the tablets T. As the position shift information is taken into account, the nozzles 51*a* to be used are also shifted in the Y direction by an amount corresponding to the position shift of the tablet T in the Y direction. Since the print data is shifted in the Y direction by an amount corresponding to Y directional variation in the supply position of the tablets T, the number of nozzles 51*a* to be used increases at least by the amount. This also contributes to, although in a small manner, equalization. Incidentally, the print data may be rotated not only depending on the variation in the supply position, but also on the Y direction shift of the nozzles 51*a* to be used to make it more appropriate. The Y direction sift may be performed within a range that does not affect the appearance of the print.

Figure 7:
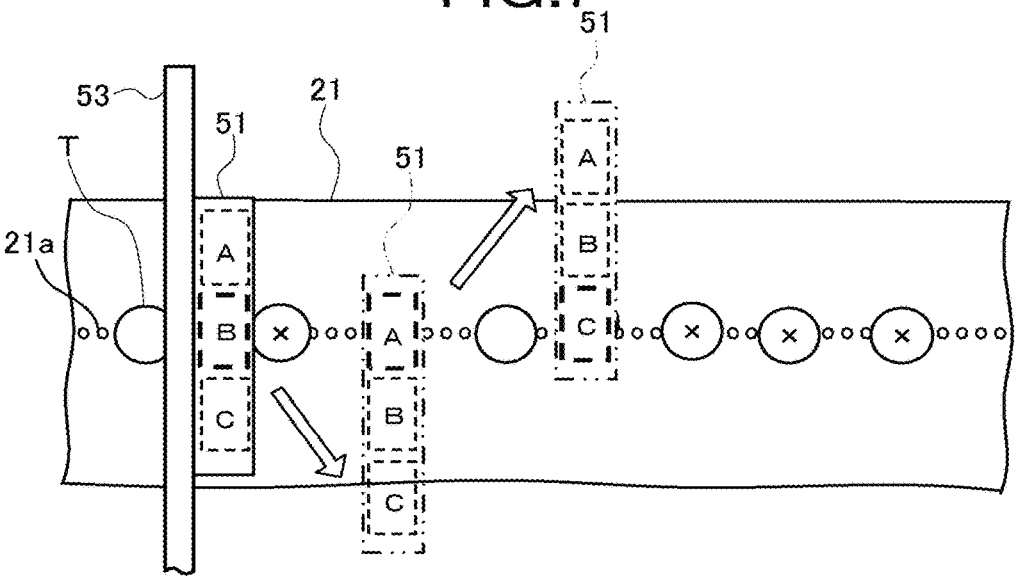
FIG. 7 is a diagram for explaining the movement of a print head.

For example, there may be provided a head moving mechanism (actuator) 53 configured to move the print heads 51 in the Y direction (an example of a direction crossing the conveying direction A1 in the horizontal plane) as illustrated in FIG. 7 to shift each of the print heads 51 in the Y direction, thereby shifting the area (range) of the nozzles 51*a* to be used. In FIG. 7, the nozzles 51*a* of one of the print heads 51 indicated by a two-dot chain line are divided into sections A, B, and C indicated by dotted lines, and the area of the nozzles 51*a* to be used is switched from the section B to the section A, and then, from the section A to the section C. Note that it does not mean that the print head 51 is moving obliquely with respect to the conveying direction A1 of the tablets T. At this time, the print pattern may be shifted in the Y direction, although it is not necessary, in addition to the shift of the print head 51. Besides, the nozzles need not necessarily be divided into sections. For example, when the print data rotation angle is 0 degrees as in FIG. 3, ejection does not take place at all from the nozzles 51*a* having hole numbers around 64 to 101; however, the nozzles 51*a* to be used may be shifted in the Y direction such that those having hole numbers 64 to 101 are to be used. Thus, the array direction of the nozzles (Y direction) in the print head 51 can be shifted relative to the printing position in this manner, nozzles in an area where their use frequency is constantly low can be shifted to an area where they are constantly used by shifting the array direction of the nozzles of the print head relative to the printing position. Thereby, it is possible to further equalize the lifetimes of the print heads 51 as a whole.

In the case of shifting the print pattern as described above, a reference pattern is shifted in the Y direction. In addition, print data may be generated at each predetermined angle based on the reference pattern shifted in the Y direction. Alternatively, the print pattern may be shifted in the Y direction with respect to each print data. With this, nozzles in an area where their use frequency is constantly low can be shifted to an area where they are constantly used. Thereby, it is possible to further equalize the lifetimes of the print heads 51 as a whole.

Further, after reducing the number of the nozzles 51*a* to be used (thinning out the nozzles 51*a* to be used), the reduced nozzles 51*a* and the selected nozzles 51*a* may be used alternately, which may be performed in combination with the above methods. If there are a plurality of nozzle arrays, they may be used while being switched from one array to another, which may be performed in combination with the above method of shifting the print pattern. For example, in the case of the print heads 51 each having two arrays of nozzles with a resolution of 300 dpi, the two arrays of nozzles 51*a* may be used alternately such that either one of the nozzle arrays is used (150 dpi printing). In the case of the print heads 51 each having an array of nozzles with a resolution of 300 dpi, every other nozzle may be used (150 dpi printing) such that the nozzles 51*a* to be used may be switched. By spreading the use time of the nozzles 51*a* in this manner, the lifetime can be further extended.

As described above, according to the first embodiment, printing conditions are changed at predetermined time intervals. With this, it is possible to balance (distribute) the ejection count of each of the nozzles 51*a*. Thereby, the time for which printing is suspended due to the maintenance of the print head 51 is reduced. As a result, it is possible to suppress a decrease in productivity due to the suspension of printing. Further, since the drive elements of the nozzles 51*a* are used in a decentralized manner, the drive elements of the print heads 51 can be more uniformly used, which prevents a drive element of specific one of the nozzles 51*a* from reaching the end of its lifetime earlier than others. Accordingly, the print heads 51 can be used for a longer time. This reduces the frequency of maintenance that requires the replacement of the print head 51 at least due to failure of a drive element or the like, thereby reducing the maintenance time. Thus, it is possible to suppress a decrease in productivity due to the suspension of printing caused by the maintenance of the print head.

Besides, in the nozzles 51*a* used at low frequency, ink is thickened, or solid matter is precipitated, which tends to result in that the ink is not properly ejected from the nozzles 51*a*. However, since the nozzles 51*a* are used in a decentralized manner, the number of the nozzles 51*a* used at low frequency decreases, which reduces the frequency of maintenance for solving the problem that ink is not properly ejected from the nozzles 51*a*. Meanwhile, ink adheres to the periphery of the nozzles 51*a* used at high frequency, which causes liquid pooling and thus prevents proper ejection of the ink. However, since the nozzles 51*a* are used in a decentralized manner, the number of the nozzles 51*a* used at high frequency decreases, which reduces the frequency of maintenance for solving the problem of liquid pooling around the nozzles 51*a*. Thereby the maintenance time can be reduced. Thus, it is possible to suppress a decrease in productivity due to the suspension of printing caused by the maintenance of the print head.

Second Embodiment

Next, a second embodiment will be described with reference to FIGS. 3 to 6 and FIG. 8. In the second embodiment, differences from the first embodiment will be described, and other descriptions will be omitted.

In the first embodiment described above, an example is described in which printing conditions are changed at predetermined time intervals during the printing process on the tablets T. Meanwhile, according to this embodiment, optimal printing conditions are set instead of that.

As illustrated in FIGS. 3 to 6, the range of the nozzles 51*a* to be used and the ejection count of the most used nozzle 51*a* greatly vary depending on the print data rotation angle. For example, when the print data rotation angle is 0 degrees, ejection from the most used nozzle 51*a* takes place nearly 45 times. On the other hand, when the print data rotation angle is degrees, ejection from the most used nozzle 51*a* takes place only 30 and a few times.

As illustrated in FIGS. 3 to 6, it was found that, in the case of printing a print pattern "XYZ 789", when the print data rotation angle is about 45 degrees, the largest number of nozzles 51*a* were used, and the drive elements of all the nozzles 51*a* could be used most uniformly. Thus, an angle at which the largest number of nozzles 51*a* are used so that their use counts are balanced and nearly uniform is determined as an optimal print data rotation angle. Although it depends on the print pattern, the optimal print data rotation angle can be known in advance by preparing data (ejection count patterns) as illustrated in FIG. 3 to FIG. 6.

Figure 8:
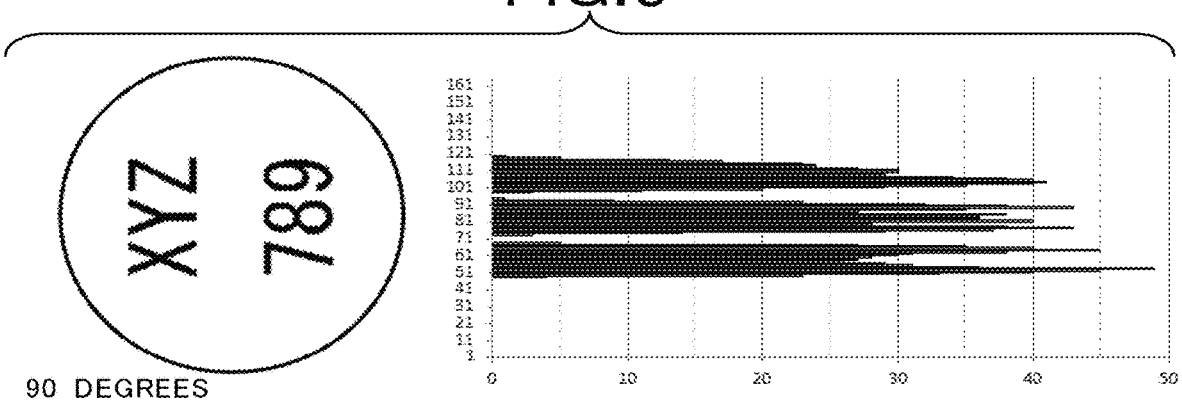
FIG. 8 is a diagram illustrating a relationship between a print pattern and nozzles in use.

FIG. 8 illustrates the ejection count of each of the nozzles 51*a* when the print data rotation angle is degrees in the case of printing a print pattern "XYZ 789" on one tablet T. When compared to the case where the print data rotation angle is 0 degrees (see FIG. 3), even less number of nozzles 51*a* are used, and ejection from the most used nozzle 51*a* takes place nearly 50 times. That is, depending on the print pattern, it is not always the case that a good result is obtained by increasing the print data rotation angle from 0 degrees, and the optimal print data rotation angle and the least favorable print data rotation angle totally vary depending on the pattern. Therefore, as described above, it is necessary to prepare data in advance for each print pattern to find out the optimal angle by experiments or the like. Incidentally, the experiment includes a simulation in which the ejection count of each nozzle is calculated at each print data rotation angle with respect to the print pattern, and ejection count patterns (distribution of ejection counts of nozzles used) are compared.

The control device 90 sets printing condition based on the optimal print data rotation angle and starts the printing process. Since the optimal printing condition is the condition under which the nozzles 51*a* can be used most uniformly, it is possible to balance the ejection count of each of the nozzles 51*a*. Thereby, the time for which printing is suspended due to the maintenance of the print head 51 is reduced. As a result, it is possible to suppress a decrease in productivity due to the suspension of printing. Although described as being selected or set by the control device 90 based on the optimal print data rotation angle, the printing condition may be set in consideration of the results obtained by an external host computer, a local arithmetic device, or the like, or may be set by the operator.

Further, when printing process is performed under optimal printing condition, the optimal printing condition may be switched to relatively suitable printing condition after a predetermined time has elapsed (at predetermined intervals). For example, in the case of the print data rotation angle of 30 degrees (see FIG. 5), less nozzles 51*a* are used than in the case where the print data rotation angle is 45 degrees (see FIG. 6); however, printing is performed with more nozzles 51*a* than in the cases of other print data rotation angles 0, 15, and 90 degrees, and the nozzles 51*a* are used more uniformly compared to the cases of other angles. The relatively suitable printing conditions are selected as such. Then, for example, printing process is performed under printing condition in which the print data rotation angle is 45 degrees. The printing condition is changed when 3 minutes as the predetermined time has elapsed, and printing process is performed under printing condition in which the print data rotation angle is 30 degrees. After the lapse of another 3 minutes, the printing condition is changed again to the condition in which the print data rotation angle is 45 degrees. In this manner, printing may be performed using the optimal printing condition and the relatively suitable printing condition alternately. Further, the switching of the print data rotation angle at predetermined intervals may be combined with how many times it is switched. For example, the printing process may be performed for 6 minutes (3 minutes×2) under printing condition in which the print data rotation angle is 30 degrees. Next, the printing process is performed for 3 minutes under printing condition in which the print data rotation angle is 0 degrees, and then the printing condition is changed to the conditions in which the print data rotation angle is 45 degrees. An optimal combination of printing conditions to be used may be found out in advance with respect to the number and locations of the nozzles 51*a* to be used, time, and the like. The print data rotation angle is not limited to between 0 to 90 degrees exemplified above, but may range up to 180 degrees or 359 degrees. Although the use of the same nozzles 51*a* and a pattern of ejection counts emerge depending on the print pattern, the combination may be appropriately determined as described above. In any of the above cases, it is possible to balance the ejection count of each of the nozzles 51*a*. Thereby, the time for which printing is suspended due to the maintenance of the print head 51 is reduced. As a result, it is possible to suppress a decrease in productivity. Further, since the drive elements of the nozzles 51*a* are used in a decentralized manner, they can be more uniformly used. Thus, as compared to conventional ones, a drive element of specific one of the nozzles 51*a* can be prevented from reaching the end of its lifetime earlier than others. Accordingly, the print heads 51 can be used for a longer time.

Figure 3:
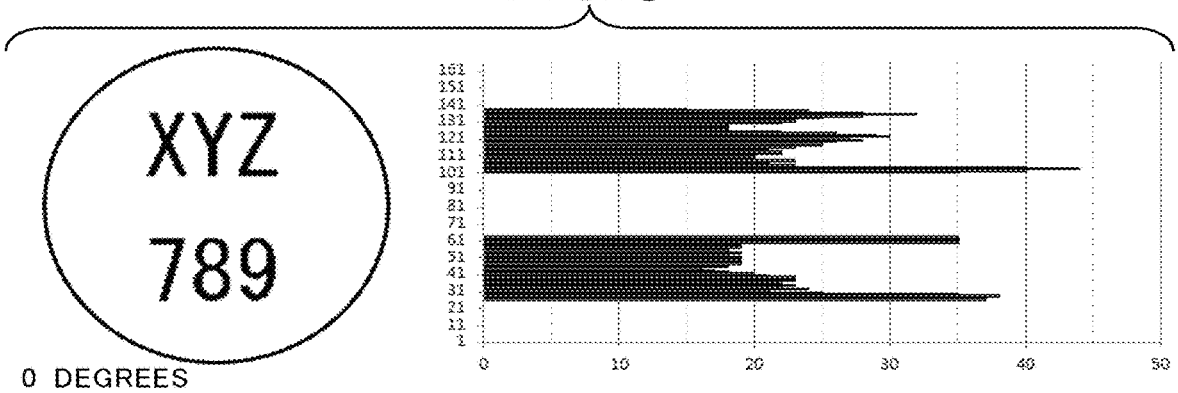
FIG. 3 is a diagram illustrating a relationship between a print pattern and nozzles in use.
Figure 4:
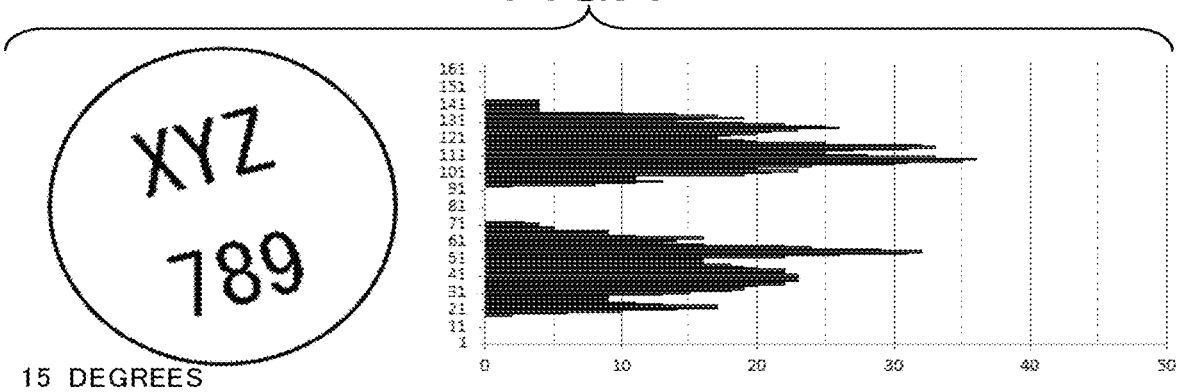
FIG. 4 is a diagram illustrating a relationship between a print pattern and nozzles in use.
Figure 5:
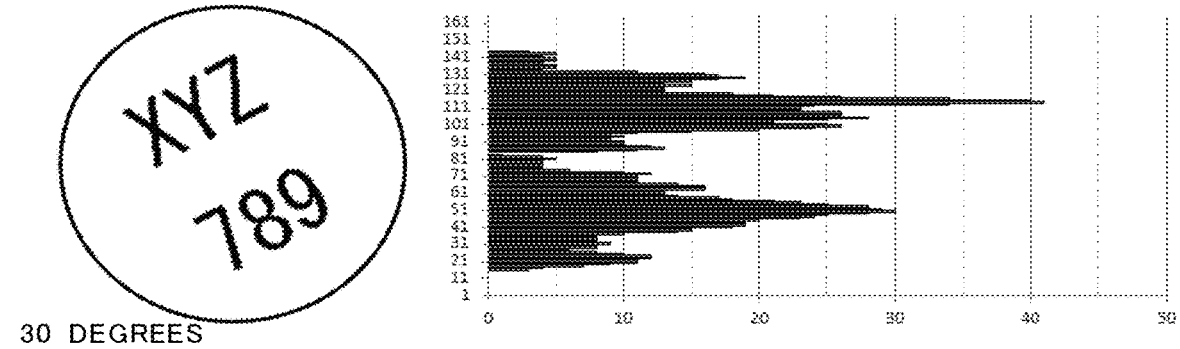
FIG. 5 is a diagram illustrating a relationship between a print pattern and nozzles in use.
Figure 6:
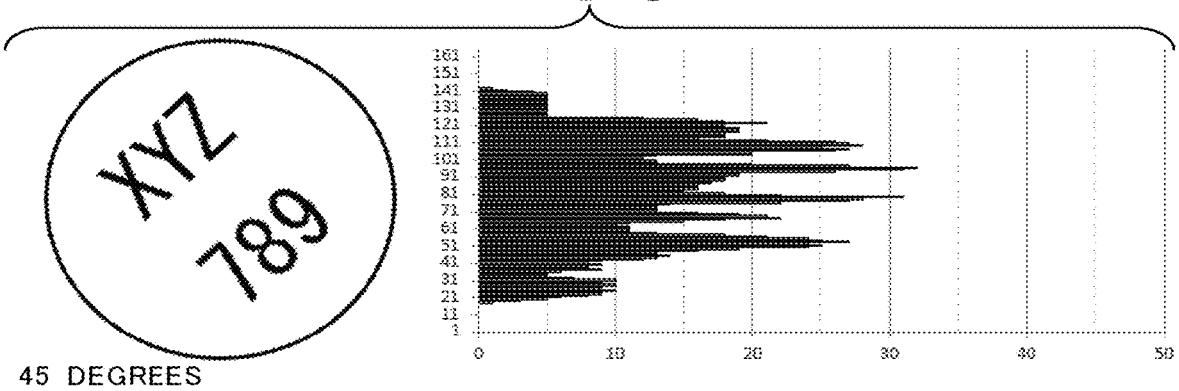
FIG. 6 is a diagram illustrating a relationship between a print pattern and nozzles in use.

Besides, it does not necessarily require a combination of suitable printing condition and optimal printing condition. In order to use the nozzles 51*a* even just a little more uniformly, the print data rotation angle can be changed periodically (at predetermined intervals). As an example, the print data rotation angle of a print pattern "XYZ 789" is changed by 180 degrees. For example, when the print data rotation angle is 0 degrees, there is a difference between the pattern of ejection counts for "XYZ" and that for "789" as illustrated in FIG. 3. When the print data rotation angle is changed from 0 degrees to 180 degrees, the print pattern is turned upside down. Accordingly, ejection is performed in such a manner that the ejection patterns for "XYZ" and "789" are overlapped. Thus, the uniform use of the nozzles can be achieved.

Further, since the nozzles 51*a* are used in a decentralized manner, the number of the nozzles 51*a* used at high frequency decreases, which reduces the frequency of maintenance for solving the problem that the nozzles 51*a* cannot properly eject ink (clogged) as in the first embodiment.

Other Embodiments

In the above embodiments, the conveyor belt 21 is described as having a plurality of suction ports 21*a*; however, this is by way of example and not limitation. The conveyor belt 21 may be provided with a slit formed along the conveying direction A1 instead of the suction ports 21*a*.

In the above embodiments, the tablets T are described as being sequentially supplied from the supply device 10 onto the conveyor belt 21 not at regular intervals but at random; however, this is by way of example and not limitation. For example, the tablets T may be supplied to recesses (pockets) formed regularly in the conveyor belt 21.

In the above embodiments, the tablets T are described as being conveyed by the conveyor belt 21 in two rows; however, this is by way of example only. There may be one row, three rows, or four or more rows, and the number of rows is not particularly limited. Besides, although an example is described in which each of the print heads 51 performs printing on one row of tablets T, it is not so limited. For example, there may be provided one print head 51 on two or more rows of tablets T. Further, there may be provided a plurality of conveyor belts 21.

In the above embodiments, a conveying device that conveys the tablets T while holding them by suction is described as an example of the conveying device 20; however, it is not so limited, and a variety of conveying mechanisms can be used.

In the above embodiments, an example is described in which the timing of printing is determined based on the detection signal from the detecting device 30; however, it is not so limited. For example, the timing of printing may be determined based on the imaging of the imaging device 40.

In the above embodiments, the storage 93 of the control device 90 is described as storing five pieces of print data, i.e., 0° print data, 15° print data, 30° print data, and 45° print data, obtained by rotating a print pattern such as characters, letters, or marks; however, this is by way of example only, and there may be any number of pieces of print data. Note that, as the variation of the print data rotation angle increases, more optimal printing conditions can be found, which is favorable. As described above, the conditions are found by experiments or the like. The control device 90 may obtain the number of nozzles to be used with respect to each of different print data rotation angles based on the print data, the locations of the nozzles, and the like to set printing condition based on a print data rotation angle at which the largest number of nozzles are used.

As an example of a tablet on which printing can be performed without considering the directionality, the tablet T is described as being completely circular in plan view. However, the tablet need not necessarily be completely circular to satisfy this condition. Any tablet can be used as long as printing can be performed thereon without considering its orientation.

For example, the control device 90 may store only print data of a single reference angle, for example, a print pattern (reference data) having a print data rotation angle of 0 degrees in the storage 93, and obtain rotated print data each time to change printing condition. However, as described in the above embodiments, if a plurality of pieces of print data are stored in advance, printing condition can be easily changed, and also the time required for printing can be reduced.

In the above embodiments, a print head in which the nozzles 51*a* are arranged in an array is described as an example of the inkjet print heads 51; however, it is not so limited. For example, a print head in which the nozzles 51*a* are arranged in a plurality of arrays may be used.

In the above embodiments, the angle of the print pattern is changed at predetermined time intervals; however, it is not so limited, and it may be changed based on the number of tablets on which printing has been performed. The angle of the print pattern may also be changed with respect to each tablet. It suffices if the angle is changed at intervals that suppress an increase in the time for which each of the nozzles 51*a* are used and the number of times it is used so that the nozzles 51*a* can be used more uniformly. How the angle is changed is appropriately determined depending on the print pattern.

Besides, ink may accumulate around the nozzles 51*a* where ejection takes place frequently, while the viscosity of the ink may increase in the nozzles 51*a* where ejection takes place at low frequency. In either case, the print quality decreases due to ejection failure such as that the nozzles cannot eject ink in an appropriate amount or a proper direction. Therefore, it is necessary to perform maintenance such as the cleaning of the nozzles 51*a* before such situations arise. Since the nozzles 51*a* are used uniformly, it takes more time until the above situations occur. Thus, the frequency of maintenance can be reduced. Therefore, the switching may be performed at intervals taking into account such ejection failure.

The above-described tablets may include tablets for pharmaceutical use, edible use, cleaning, industrial use, and aromatic use. Examples of the tablets include plain tablets (uncoated tablets), sugar-coated tablets, film-coated tablets, enteric coated tablets, gelatin coated tablets, multilayered tablets, dry-coated tablets, and the like. Examples of the tablet further include various capsule tablets such as hard capsules and soft capsules. Although the tablets are described as being completely circular in plan view, the shape is not so limited. Any tablet can be used as long as printing can be performed thereon without considering the directionality. Further, although the tablets are described as having no split line, the embodiments can be applied to printing on those having a split line on one side if printing is performed on the other side without considering the directionality.

In the case where tablets to be printed are for pharmaceutical use or edible use, edible ink is suitably used. Specifically, edible pigments such as Amaranth, Erythrosine, New Coccine (red), Tartrazine, Sunset Yellow FCF, β-Carotene, Crocin (yellow), Brilliant Blue FCF, Indigo Carmine (blue), or the like are dispersed or dissolved in a vehicle, and, if necessary, a pigment dispersant (surfactant) is blended therein, the resultant of which can be used. As the edible ink, any of synthetic dye ink, natural color ink, dye ink, and pigment ink may be used.

In the above embodiments, an example is described in which printing is performed on one side of the tablets T. However, if there is no need to consider the directionality for printing on both the front and back sides of the tablets T, the embodiments can be applied to printing on both the front and back sides by using two apparatuses illustrated in FIG. 1: the first apparatus for printing on one side of tablets, and the second apparatus for printing on the other side of the tablets transferred from the first one. If a print pattern (first print pattern) printed on one side is different from a print pattern (second print pattern) printed on the other side, the print patterns of the first and second apparatuses may be switched at predetermined intervals. Specifically, the print patterns can be switched such that the first apparatus performs printing of the print pattern (second print pattern) on the other side, while the second apparatus performs printing of the print pattern (first print pattern) on one side. For example, in the case of printing a print pattern "ABC" on one side of the tablets T and a print pattern "456" on the other side, a state where "ABC" is printed by the first apparatus and "456" is printed by the second apparatus is switched to a state where "456" is printed by the first apparatus and "ABC" is printed by the second apparatus at a predetermined interval. This switching can be performed in combination with the switching of pieces print data obtained by rotating a print pattern. Even in the same printing process on the tablets T, the print heads 51 of the first and second apparatuses perform printing with different print patterns. Thus, the nozzles 51*a* can be used more uniformly.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveyor configured to convey a tablet having an outer shape that does not determine printing direction of a print pattern to be printed thereon;

an inkjet print head including a plurality of nozzles each configured to eject a liquid to print the print pattern on the tablet being conveyed;

an imager located on an upstream side of the inkjet print head in a conveying direction of the tablet and capturing an image of the tablet being conveyed;

an image processor receiving the image captured by the imager, detecting a position shift of the tablet, and generating a position shift information of the tablet; and a controller controlling the inkjet print head based on printing conditions;

wherein the controller is configured to control the inkjet print head to perform printing on the tablet being conveyed, while correcting the printing conditions by the position shift information of the tablet received from the image processor, such that the printing direction of the print pattern is changed at predetermined intervals at least between a first direction which is parallel to or traverses the conveying direction of the tablet, and a second direction which traverses the first direction, and wherein more nozzles are used for printing than in the first direction.

2. The tablet printing apparatus according to claim 1, wherein the controller is further configured to control the inkjet print head to perform printing on the tablet being conveyed by changing the printing conditions such that the printing direction of the print pattern is changed at predetermined intervals among the first direction, the second direction, a third direction in which more nozzles are used for printing than in the first direction, and a fourth direction in which more nozzles are used for printing than in the first direction, and the second, third, and fourth directions are different from one another, wherein the controller is configured to control the inkjet print head based on the printing conditions for the third and fourth directions while correcting the printing conditions by the position shift information of the tablet received from the image processor.

3. The tablet printing apparatus according to claim 2, wherein, when the first direction is 0 degrees with respect to the conveying direction, the second direction is 15 degrees, the third direction is 30 degrees, and the fourth direction is 45 degrees.

4. A tablet printing apparatus, comprising:

a conveyor configured to convey a tablet having an outer shape that does not determine printing direction of a print pattern to be printed thereon;

an inkjet print head including a plurality of nozzles each configured to eject a liquid to print the print pattern on the tablet being conveyed;

an imager located on an upstream side of the inkjet print head in a conveying direction of the tablet and capturing an image of the tablet being conveyed;

an image processor receiving the image captured by the imager, detecting a position shift of the tablet, and generating a position shift information of the tablet; and a controller controlling the inkjet print head based on printing conditions;

wherein the controller is configured to control the inkjet print head to perform printing on the tablet being conveyed, while correcting the printing conditions by the position shift information of the tablet received from the image processor, such that the printing direction of the print pattern is set in a direction which traverses the conveying direction of the tablet, and in which more nozzles are used for printing than when the print pattern is printed in a direction parallel to the conveying direction.

5. The tablet printing apparatus according to claim 4, wherein the controller is further configured to control the inkjet print head to perform printing on the tablet being conveyed such that the print pattern is printed in a direction which traverse the conveying direction, and in which the largest number of nozzles are used for printing.

6. The tablet printing apparatus according to claim 1, wherein the tablet having an outer shape that does not determine the printing direction of the print pattern is circular in plan view.

7. The tablet printing apparatus according to claim 2, wherein the tablet having an outer shape that does not determine the printing direction of the print pattern is circular in plan view.

8. The tablet printing apparatus according to claim 3, wherein the tablet having an outer shape that does not determine the printing direction of the print pattern is circular in plan view.

9. The tablet printing apparatus according to claim 4, wherein the tablet having an outer shape that does not determine the printing direction of the print pattern is circular in plan view.

10. The tablet printing apparatus according to claim 5, wherein the tablet having an outer shape that does not determine the printing direction of the print pattern is circular in plan view.

11. A tablet printing method, comprising:

conveying, by a conveyor, a tablet having an outer shape that does not determine printing direction of a print pattern to be printed thereon;

printing, by an inkjet print head, the print pattern on the tablet being conveyed, the inkjet print head including a plurality of nozzles each configured to eject a liquid;

capturing, by an imager, an image of the tablet being conveyed, the imager located on an upstream side of the inkjet print head in a conveying direction of the tablet;

receiving, by an image processor, the image captured by the imager, detecting a position shift of the tablet, and generating a position shift information of the tablet; and controlling, by a controller, the inkjet print head based on printing conditions to perform printing on the tablet being conveyed, while correcting the printing conditions by the position shift information of the tablet received from the image processor, such that the printing direction of the print pattern is changed at predetermined intervals at least between a first direction which is parallel to or traverses the conveying direction of the tablet, and a second direction which traverses the first direction, and in which more nozzles are used for printing than in the first direction.

12. The tablet printing method according to claim 11, wherein the controller controls the inkjet print head to perform printing on the tablet being conveyed by changing the printing conditions such that the printing direction of the print pattern is changed at predetermined intervals among the first direction, the second direction, a third direction in which more nozzles are used for printing than in the first direction, and a fourth direction in which more nozzles are used for printing than in the first direction, and the second, third, and fourth directions are different from one another, wherein the controller is configured to control the ink jet print head based on the printing conditions for the third and fourth directions while correcting the printing conditions by the position shift information of the tablet received from the image processor.

13. The tablet printing method according to claim 12, wherein, when the first direction is 0 degrees with respect to the conveying direction, the second direction is 15 degrees, the third direction is 30 degrees, and the fourth direction is 45 degrees.

14. A tablet printing method, comprising:

conveying, by a conveyor, a tablet having an outer shape that does not determine printing direction of a print pattern to be printed thereon;

printing, by an inkjet print head, the print pattern on the tablet being conveyed, the inkjet print head including a plurality of nozzles each configured to eject a liquid;

capturing, by an imager, an image of the tablet being conveyed, the imager located on an upstream side of the inkjet print head in a conveying direction of the tablet;

receiving by an image processor, the image captured by the imager, detecting a position shift of the tablet, and generating a position shift information of the tablet; and controlling, by a controller, the inkjet print head based on printing conditions to perform printing on the tablet being conveyed, while correcting the printing conditions by the position shift information of the tablet received from the image processor, such that the printing direction of the print pattern is set in a direction which traverses the conveying direction of the tablet, and in which more nozzles are used for printing than when the print pattern is printed in a direction parallel to the conveying direction.

15. The tablet printing method according to claim 14, wherein the controller controls the inkjet print head to perform printing on the tablet being conveyed such that the print pattern is printed in a direction which traverses the conveying direction, and in which the largest number of nozzles are used for printing.

16. The tablet printing method according to claim 11, wherein the tablet having an outer shape that does not determine the printing direction of the print pattern is circular in plan view.

17. The tablet printing method according to claim 12, wherein the tablet having an outer shape that does not determine the printing direction of the print pattern is circular in plan view.

18. The tablet printing method according to claim 13, wherein the tablet having an outer shape that does not determine the printing direction of the print pattern is circular in plan view.

19. The tablet printing method according to claim 14, wherein the tablet having an outer shape that does not determine the printing direction of the print pattern is circular in plan view.

20. The tablet printing method according to claim 15, wherein the tablet having an outer shape that does not determine the printing direction of the print pattern is circular in plan view.

* * * * *